US007307507B2

(12) United States Patent
Darr et al.

(10) Patent No.: US 7,307,507 B2
(45) Date of Patent: Dec. 11, 2007

(54) FUSE STATE INDICATOR

(75) Inventors: Matthew R. Darr, Godfrey, IL (US); Virgil Hampton, Granite City, IL (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 11/512,777

(22) Filed: Aug. 30, 2006

(65) Prior Publication Data

US 2006/0290461 A1 Dec. 28, 2006

Related U.S. Application Data

(63) Continuation of application No. 10/823,905, filed on Apr. 14, 2004, now Pat. No. 7,119,651.

(51) Int. Cl.
*H01H 85/30* (2006.01)
*H01H 85/02* (2006.01)

(52) U.S. Cl. ..... 337/243; 337/206; 337/241

(58) Field of Classification Search ..... 337/153, 337/182–184, 206, 241–243, 265–267
See application file for complete search history.

(56) References Cited

U.S. PATENT DOCUMENTS

| | | | | |
|---|---|---|---|---|
| 737,280 | A | 8/1903 | Sachs | |
| 809,978 | A | 1/1906 | Ogle | |
| 914,043 | A * | 3/1909 | Hart et al. | 337/241 |
| 1,246,417 | A | 11/1917 | Gilbert | |
| 1,265,223 | A | 5/1918 | Marcus | |
| 1,927,336 | A | 9/1933 | Cole | |
| 2,175,250 | A | 10/1939 | Burrows et al. | |
| 4,127,837 | A | 11/1978 | Borchart | |
| 4,560,971 | A * | 12/1985 | Oh | 337/164 |
| 5,418,516 | A | 5/1995 | Oh | |
| 6,373,370 | B1 | 4/2002 | Darr et al. | |
| 6,566,996 | B1 | 5/2003 | Douglass et al. | |

* cited by examiner

*Primary Examiner*—Anatoly Vortman
(74) *Attorney, Agent, or Firm*—King & Spalding

(57) ABSTRACT

A fuse state indicator for a fuse including a cylindrical fuse body and a primary fuse element therein, includes an extension member, a transparent lens, a combustible substance adjacent the lens, a secondary fuse link adjacent said combustible substance, and a curved backing layer adjacent said secondary fuse link. Said backing layer is at least partially concealed by said combustible substance when viewed through said transparent lens before the fuse has opened, and said backing layer maintains said secondary fuse link in position with respect to said combustible substance.

17 Claims, 5 Drawing Sheets

FUSE STATE INDICATOR

CROSS REFERENCE TO RELATED APPLICATIONS

This application is a continuation application of U.S. patent application Ser. No. 10/823,905 filed Apr. 14, 2004 now U.S. Pat. No. 7,119,651.

BACKGROUND OF THE INVENTION

This invention relates generally to fuses and, more particularly, to fuses with a fuse state indicator.

Fuses are widely used as overcurrent protection devices to prevent costly damage to electrical circuits. Fuse end caps typically form an electrical connection between an electrical power source and an electrical component or a combination of components arranged in an electrical circuit. A fusible link is connected between the fuse end caps, so that when electrical current flowing through the fuse exceeds a predetermined limit, the fusible link melts and opens the circuit through the fuse to prevent electrical component damage.

Various types of fuse state indicators have been developed in an attempt to more efficiently locate opened fuses for replacement. For example, U.S. Pat. No. 6,566,996 to Douglass et al., is directed toward a combustible fuse state indicator which is notable both for its low cost construction and its reliability in comparison to other types of indicators. The combustible fuse state indicator of the '996 patent includes a combustible substance located adjacent a transparent lens extending through a side of a rectangularly shaped fuse module. A secondary fuse link extends adjacent the combustible substance and heat associated with opening of the secondary fuse link ignites the combustible substance to reveal a backing layer of a contrasting color. The fuse state indicator of the '996 patent, however, is designed for use with a rectangular fuse module, and implementing such an indicator in other types of fuses presents a number of issues.

For example, in a cylindrical or cartridge fuse, the fuse indicator assembly must be accommodated in a comparatively smaller space than in a rectangular fuse module. Also, the secondary fuse link for the indicator must be electrically connected interior to the fuse body to conductive end caps or terminal elements coupled to the fuse body. Reliably establishing the electrical connection and properly orienting the secondary fuse link with respect to the combustible substance is difficult. Also, due to the curvature of the fuse body, the backing layer beneath the combustible substance can be difficult to see when the combustible substance is consumed.

It would therefore be desirable to provide a fuse state indicator that is more amenable to use in other types of fuses, such as cylindrical fuses, than the indicator described in the '996 patent for a rectangular fuse module.

BRIEF DESCRIPTION OF THE INVENTION

According to an exemplary embodiment of the present invention, a fuse state indicator for a fuse including a cylindrical fuse body and a primary fuse element therein is provided. The fuse state indicator comprises an extension member, a transparent lens, a combustible substance adjacent the lens, a secondary fuse link adjacent the combustible substance, and a curved backing layer adjacent the secondary fuse link. The backing layer is at least partially concealed by the combustible substance when viewed through the transparent lens before the fuse has opened, and the backing layer maintains the secondary fuse link in position with respect to the combustible substance.

Optionally, the extension member is elongated in a longitudinal direction and curved in a lateral direction. Conductive clips may be provided to electrically connect the secondary fuse link to end caps of a fuse. Alternatively, the secondary fuse link comprises a high resistance portion and a low resistance portion for termination with the fuse end caps.

According to another exemplary embodiment, an electric fuse comprises a tubular fuse body having a first end, a second end, and an aperture for fuse state identification. First and second end caps are coupled to the body, and a primary fuse element is electrically connected between the first and second end caps. A fuse indicator assembly comprises a secondary fuse link electrically connected between the first and second end caps, a combustible substance adjacent the secondary fuse link, and a flexible backing layer coupled to an extension member and maintaining the secondary fuse link in position with respect to the combustible substance.

According to another exemplary embodiment, an electric fuse comprises a tubular fuse body having a first end and a second end and an aperture for fuse state identification, first and second end caps coupled to the body, a primary fuse element electrically connected between the first and second end caps, and a fuse indicator assembly. The indicator assembly comprises an extension member, a secondary fuse link electrically connected between the first and second end caps, a combustible substance adjacent the secondary fuse link, and a flexible backing layer coupled to the extension member and adjacent the secondary fuse link. The flexible backing layer maintains the secondary fuse link in position proximate the combustible substance for visible fuse state indication through the aperture of the fuse body by the presence or absence of the combustible substance.

In still another embodiment, a fuse state indicator for a fuse including a primary fuse element in an insulative body is provided. The insulative body has an aperture therethrough for fuse state identification, and the fuse state indicator comprises an insulative extension member defining a cavity, a combustible substance received within the cavity, and a secondary fuse link extending across the extension member and the cavity such that the secondary fuse link is positioned adjacent the combustible substance. A flexible backing layer is coupled to the extension member and closes the cavity over the combustible substance, wherein the secondary fuse link is positioned between the backing layer and the combustible substance. The backing layer is at least partially concealed by the combustible substance when viewed through aperture in insulative fuse body before primary fuse element has opened, and the backing layer maintains the secondary fuse link in position with respect to the combustible substance.

DETAILED DESCRIPTION OF THE INVENTION

Figure 1:
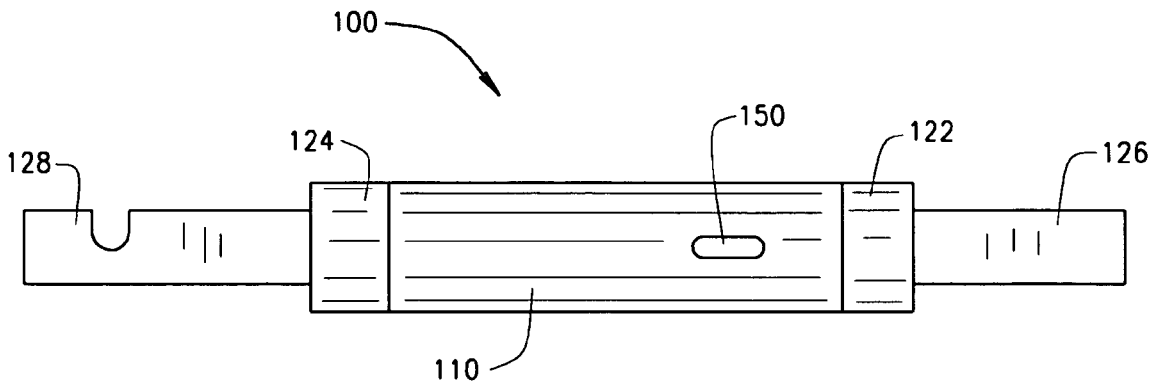
FIG. 1 is a perspective view of an exemplary fuse including a state indicator.

FIG. 1 is a perspective view of an exemplary embodiment of a fuse 100 including a cylindrical fuse tube or body 110 having an aperture 150 extending therethrough at a location proximate to a first end of fuse body 110, and conductive ferrules or end caps 122, 124 are attached to the fuse body 110 on either end thereof. In an exemplary embodiment, the end caps 122, 124 include knife blades 126, 128 respectively, which may be connected to line side and load side electrical circuitry (not shown), thereby forming a current path through a primary fuse element (not shown in FIG. 1). In accordance with known fuses, the primary fuse element may include one or more fusible links or a fuse element assembly extending through the fuse body 110 between the end caps 122, 124.

A fuse state indicator assembly (not shown in FIG. 1) extends interior to the fuse body 110 and a portion of the fuse state indicator is visible through the aperture 150 in the body 110 to indicate an operating condition or state of the fuse 100. The fuse state indictor is electrically connected to the end caps 122, 124 in the manner explained below, and indicates the state of the primary fuse element (i.e. an unopened state wherein current is conducted through the fuse element or an opened state wherein the circuit through the fuse element is broken).

In an exemplary embodiment, the fuse body 110 is elongated and is generally cylindrical, although it is appreciated that the benefits of the instant invention may apply to non-cylindrical fuses in alternative embodiments. Further, it is understood that the invention is applicable to a wide variety of fuses intended for a wide variety of applications and having a wide variety of fuse ratings. Therefore, the embodiments of the invention shown and described herein are for illustrative purposes only, and the invention is not intended to be restricted to a particular fuse shape type, class or rating.

Figure 2:
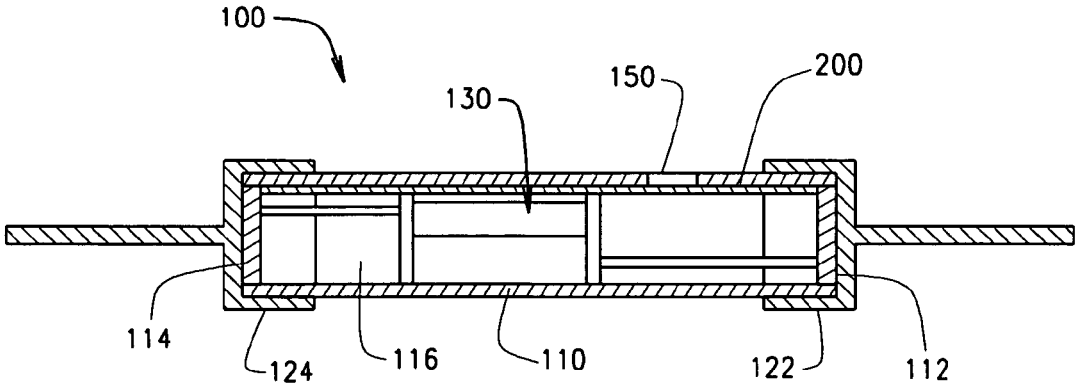
FIG. 2 is a cross sectional view of the fuse shown in FIG. 1.

FIG. 2 is a cross sectional view of the fuse 100 illustrating the fuse body 110 having a first end 112, a second end 114 and an interior bore 116 which contains a primary fuse element assembly 130. In the illustrated embodiment, the primary fuse element assembly 130 is a known dual element, time delay fuse element assembly. In alternative embodiments, a wire fuse link, a fuse element strip, or other known fuse element or fusible link construction may be employed in the fuse 100. Additionally, more than one fuse link or element assembly may be employed in further embodiments of the invention.

The first end cap 122 and the second end cap 124 include inner surfaces that fit over the first end 112 and the second end 114, respectively, of the fuse body 110. The fuse element assembly 130 and a fuse state indicator assembly 200 are electrically connected in parallel between the end caps 122, 124 in the interior of the bore 116 extending through the body 110. The aperture 150 of the body 110 extends from the interior of the bore to the exterior of the body 110 and is adapted to accept a portion of the fuse state indicator assembly 200 in the manner explained below when the fuse state indicator assembly 200 is installed in the fuse body 110. In accordance with known fuses, the fuse body 110 is filled with an arc energy absorbing material (not shown in FIG. 2), such as quartz sand which absorbs heat generated in the primary fuse element assembly 130 in an overcurrent condition as the primary fuse element opens.

Figure 3:
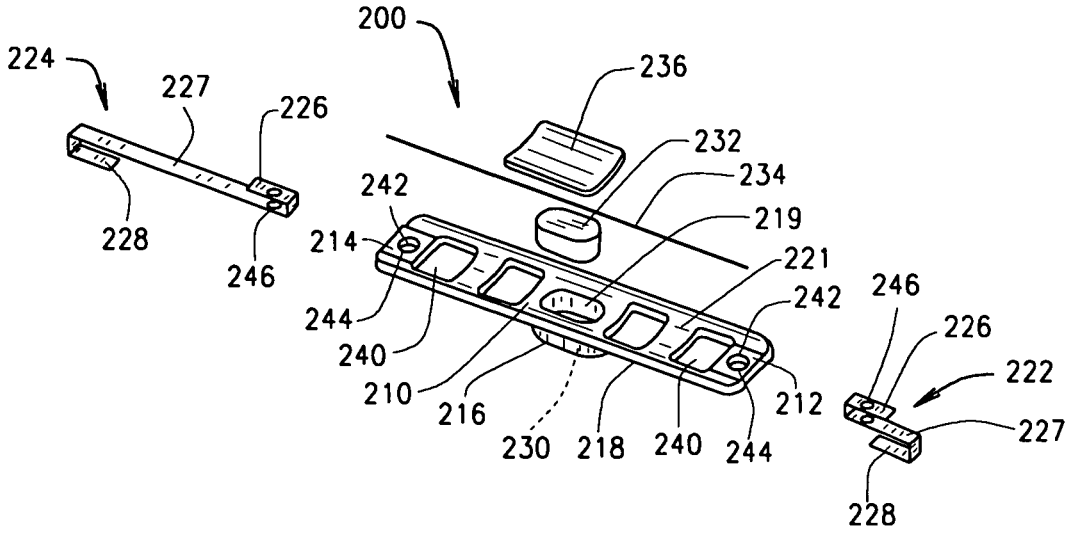
FIG. 3 is an exploded bottom perspective view of a fuse state indicator assembly for the fuse shown in FIGS. 1 and 2.

FIG. 3 is an exploded view of an exemplary embodiment of the fuse state indicator assembly 200. In the illustrative embodiment, the fuse state indicator assembly 200 includes an insulative extension member 210 having a recessed cylindrical housing 216 extending therefrom, a transparent lens 230 coupled to the housing 216, a combustible substance 232 disposed within the housing 216, a secondary fuse link 234 extending across the extension member 210, and a flexible backing layer 236.

In an exemplary embodiment, the extension member 210 is generally bowed or curved, and has a radius substantially equal to an inner radius of the fuse body 100 (as shown in FIGS. 1 and 2) so that a top surface 218 of the extension member 210 maintains contact with an inner surface of the fuse body 110. The extension member 210 is elongated in a longitudinal direction and curved in a lateral direction so that the extension member maintains contact with the inner surface of the fuse body 110. The curvature of the extension member 210 is substantially complementary to the curvature of the fuse body 110 (shown in FIG. 2) although at a slightly reduced curvature, such that a top surface 218 of the extension member may underlie the interior surface of the bore 116 of the body 110 (shown in FIG. 2) when the fuse state indicator assembly 200 is installed.

The extension member 210 includes the recessed cylindrical housing 216 extending from the top surface 218 of the extension member 210, and the housing defines an opening or cavity 219 extending therein from a bottom surface 221 of the extension member 210. In one embodiment, the housing 216 includes crush ribs (not shown in FIG. 3) on the outer surfaces thereof which anchor the housing 216 and the extension member 210 to the body 110 (shown in FIGS. 1 and 2) when the housing 216 is extended through the aperture 150 (shown in FIGS. 1 and 2) during installation of the indicator assembly 200.

The housing 216 contains the transparent lens 230 at an outer surface of the recessed cylindrical housing 216 at a distance from the top surface 218 of the extension member. In an exemplary embodiment, the transparent lens 230 is fabricated from suitable materials known in the art, including, but not limited to, polycarbonate, polysulfone, polyethersulfone, and acrylic. The recessed cylindrical housing 216 receives the combustible substance 232 in the cavity 219 for fuse state indication as described below.

In an exemplary embodiment, the combustible substance 232 is a tuft of nitrocellulose cotton that is easily ignitable and substantially fills the recessed cylindrical housing 216. The combustible substance 232 rests upon the flexible backing layer 236 at a distance below the transparent lens 230. In one embodiment, the combustible substance 232 fills the cylindrical housing and contacts the transparent lens 230. In an alternative embodiment, the combustible substance 232 only partially fills the cylindrical housing 216, thereby creating an insulating air gap (not shown) between the transparent lens 230 and the combustible substance 232 that. both provides for combustion of the combustible substance and protects the transparent lens 230 from the associated heat when the secondary fuse link 234 ignites the combustible substance 232. The combustible substance 232 has a contrasting color relative to the flexible backing layer 236, which may be any contrasting color relative to the combustible substance 232 for ready indication of the fuse state, as described further below. In one embodiment, the combustible substance 232 is white and the flexible backing layer 236 is black.

In a further embodiment, a known energetic chemical compound may be used to assist ignition of the combustible substance 232. One such energetic chemical compound is described in commonly owned U.S. Pat. No. 6,556,996. It is contemplated, however, that other compounds may be employed in other embodiments to assist or facilitate ignition and combustion of the combustible substance 232.

In alternative embodiments, other readily combustible materials known in the art may be used in lieu of nitrocellulose cotton as the combustible substance 232. For example, pure nitrocellulose, combustible substances such as cellulose paper, polymer film, polymer felt, and cellulose felt may be used within the scope of the present invention. In such embodiments, the combustible substance 232 is located adjacent and/or within the recessed cylindrical housing 216 in various forms, including but not limited to circular disks that are, for example, 0.001 inches to 0.010 inches thick. The disks may be dimensioned to be larger in circular dimension than the housing 216 and/or the transparent lens 230 so that the combustible substance 232 extends beyond the transparent lens 230 and the recessed cylindrical housing 216.

In an exemplary embodiment, the secondary fuse link 234 of the fuse state indicator 200 is electrically connected in parallel with the primary fuse element assembly 130 (shown in FIG. 2) through a first clip 222 and a second clip 224 as described below. The secondary fuse link 234 has a much higher electrical resistance than the primary fuse element assembly 130 so that, during normal operation of the fuse, substantially all of the current passing through the fuse passes through the primary fuse element assembly 130. In one embodiment, the secondary fuse link 234 is a fine wire selected to melt at a designated current in accordance with a desired amperage rating of fuse. In alternative embodiments, the secondary fuse link 234 may be fabricated from a variety of materials known in the art, including but not limited to copper, and copper alloys including zinc, nickel, chromium, tin, iron, molybdenum, aluminum, berylium, and silicon.

The flexible backing layer 236 is disposed adjacent and extends beyond the combustible substance 232 so as to be concealed or hidden from view by the combustible substance 232 when viewed through the top of the transparent lens 230. The flexible backing layer 236 is of a contrasting color relative to the combustible substance 232, and is generally coextensive with the combustible substance 232. Disposed between the combustible substance 232 and the flexible backing layer 236 is the secondary fuse link 234.

In an exemplary embodiment, the flexible backing layer 236 includes an adhesive or tacky layer on one side thereof. The flexible backing layer 236 is applied to the extension member 210 adjacent the secondary fuse link 234 and the combustible substance 232, thereby keeping the combustible substance 232 in place within the recessed cylindrical housing 216 and maintaining the position of the secondary fuse link 234 with respect to the extension member 210. The flexible backing layer 236 is fabricated from a relatively noncombustible material relative to the combustible substance 232, and is contrasting in color relative to the combustible substance 232. In an illustrative embodiment, the flexible backing layer 236 is fabricated from, for example, black electrical tape having a sharp color contrast with the combustible substance 232, and the electrical tape secures the secondary fuse link 234 to the extension member 210 proximate the combustible substance 232. The flexibility of the electrical tape accommodates the curvilinear shape of the extension member 210 while reliably positioning the secondary fuse link 234 in proper position relative to the combustible substance 232 to ensure reliable ignition thereof upon the occurrence of a specified overcurrent condition. In further, and/or alternative embodiments, other insulative (i.e., nonconductive) materials, whether flexible or rigid, may be employed by adhesive or other attachment methods in lieu of electrical tape to accommodate the curved shape of the extension member 210.

In an exemplary embodiment, the extension member 210 further includes mounting flanges 212, 214 located on opposite ends of the extension member 210, which interface with the first clip 222 and the second clip 224 and which further interface with the secondary fuse link 234. The mounting flanges 212, 214 may be fabricated from a variety of materials known in the art, and in an exemplary embodiment, are fabricated from plastic.

In an exemplary embodiment, the first clip 222 and the second clip 224 engage both the fuse state indicator assembly 200 and the fuse body ends 112, 114. The clips 222, 224 are fabricated from a conductive material, and in the illustrative embodiment, are fabricated from strips or ribbons of conductive material, such as copper or copper alloys, including but not limited to alloys including zinc, nickel, chromium, tin, iron, molybdenum, aluminum, berylium, and silicon. The conductive clips 222 and 224 both position the extension member 210 relative to the fuse body 110 (shown in FIGS. 1 and 2) and establish an electrical connection through the secondary fuse link 234. Specifically, the clips 222 and 224 mechanically and electrically contact the fuse end caps 122 and 124 (shown in FIGS. 1 and 2) and provide a conductive path through the secondary fuse link 234 when the end caps 122 and 124 are connected to an energized circuit (not shown).

In an exemplary embodiment, the clips 222, 224 are formed or folded into a serpentine shape which engages the fuse state indicator 200 and the fuse body ends 112, 114. More specifically, the clips 222, 224 include an elongated center 227 section having each ends 226, 228 displaced from and extending generally parallel to the center section in opposite directions from the center section 227.

In an exemplary embodiment, the mounting flanges 212, 214 are positioned adjacent an aperture 240 located at each end of the extension member 210 which allows the clips 222, 224 to interface the mounting flanges 212, 214. The mounting flanges 212, 214 include apertures 242 coextensive with similarly shaped apertures 244 on either end of extension member 210. The clips 222, 224 also contain mounting apertures 246, whereby a fastener (not shown) can be inserted through each of the apertures 244, 242, and 246 in the extension member 210, the mounting flanges 212, 214, and the clips 222, 224 respectively, to secure the clips 222, 224 to the extension member 210. The fastener can be any known fastener, for example, a rivet or a screw.

The secondary fuse link 234 is electrically fastened to the clips 222, 224 so that the secondary fuse link 234 is connected in parallel with the primary fuse element assembly 130 as described above. The secondary fuse link 234 can be electrically and/or mechanically connected to the clips 222, 224 in a known manner such as soldering. In a further embodiment, the secondary fuse link 234 is inserted into the aperture 242 located within the mounting flanges 212, 214 and thereafter secured to the clips 222, 224 once the clips 222, 224 engages the mounting flanges 212, 214. In yet another embodiment, each end of the secondary fuse link 234 engages the clips 222, 224 when the respective clips 222, 224 are positioned relative to the mounting flanges 212, 214.

In an exemplary embodiment, the fuse state indicator assembly 200 functions as follows. When the primary fuse element assembly 130 opens due to a fault current, the current flows through the parallel secondary fuse link 234, which causes the secondary fuse link 234 to melt or vaporize. The resultant heat ignites the combustible substance 232, and the combustible substance 232 is consumed by confined burning within the recessed cylindrical housing 216. When the combustion is complete, the flexible backing layer 236 is visible through the transparent lens 230.

Thus, an operative condition or state of the fuse 100 is readily indicated by a visible change of color from, for example, a light color to a dark color, as seen through the transparent lens 230. The color visible through the lens 230 reflects the respective colors of the combustible substance 232 in an unopened or operative condition and the flexible backing layer 236 in an opened or inoperative state after the primary fuse element has opened. That is, to an observer viewing the transparent lens 230, when the primary fuse element assembly 130 is operable, i.e., has not melted or opened, the light-colored combustible substance is visible through the transparent lens 230. However, when the primary fuse element assembly 130 is inoperable due to melting or opening from a fault current, the current vaporizes the secondary fuse link 234, ignites and consumes the combustible substance 232, and thereby reveals the contrasting dark-colored flexible backing layer 236 so that it is visible through the transparent lens 230.

In alternative embodiments, the flexible backing layer 236 is only partially concealed by the combustible substance 232 when primary fuse element assembly 130 has not opened. For example, a light-colored stripe of the combustible substance 232 may cross a dark-colored flexible backing layer 236 such that the stripe is visible when the primary fuse element assembly 130 has not opened, and the stripe is combusted when the primary fuse element assembly 130 has opened so that only the colored flexible backing layer 236 is visible through the top of transparent lens 230. In a further alternative embodiment, the flexible backing layer 236 includes text and/or graphics that become visible when the combustible substance 232 is combusted to indicate the state of the fuse 100.

Figure 4:
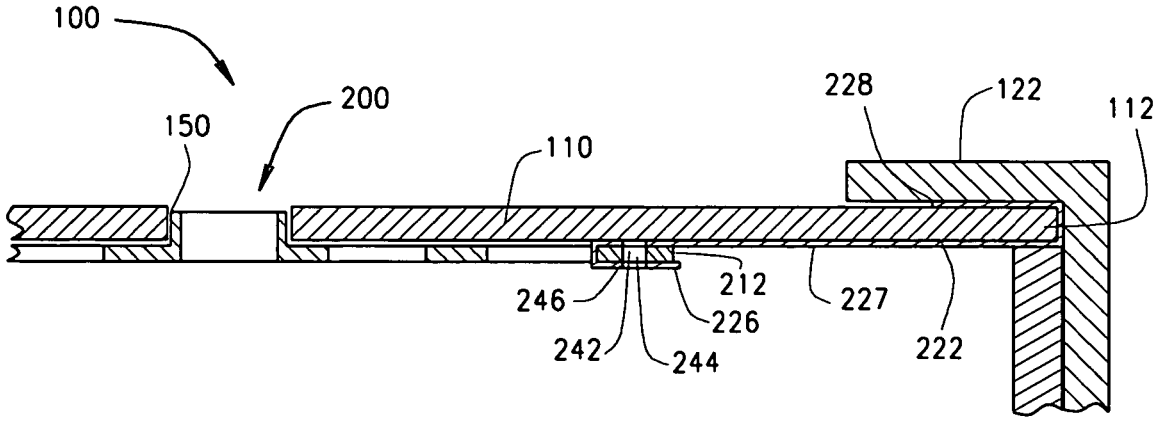
FIG. 4 is a cross sectional view of a portion of the fuse shown in FIGS. 1 and 2.

FIG. 4 is a cross sectional view of the fuse 100 showing the placement of the first clip 222 in an exemplary embodiment. The second clip 224 (not shown in FIG. 4) is placed around the second end 114 of the fuse body 110 in a similar manner. In an exemplary embodiment, as shown in FIG. 4, when the fuse state indicator assembly 200 is inserted into the aperture 150, second end 228 of the clip 222 engages the fuse body 110 by folding the second end 228 over the first end 112 of the fuse body 110 as shown. The first end 226 of the clip 222 engages the mounting flange 212 of the extension member 210 as described above. The elongated center 227 of the clip 222 is positioned adjacent the fuse body 110 and extends from the extension member 210 to the fuse body first end 112, and each clip end 226 and 228 extends generally parallel to the center section in opposite directions.

The second end 228 of the clip 222 is folded over the fuse body first end 112. The end 228 of the first clip 222 is electrically connected to the first end cap 122 when the end cap 122 is installed over the first end 112 of the fuse body 110. The first end cap 122 is connected to the fuse body 110 as generally known in the art, for example by crimping.

Figure 5:
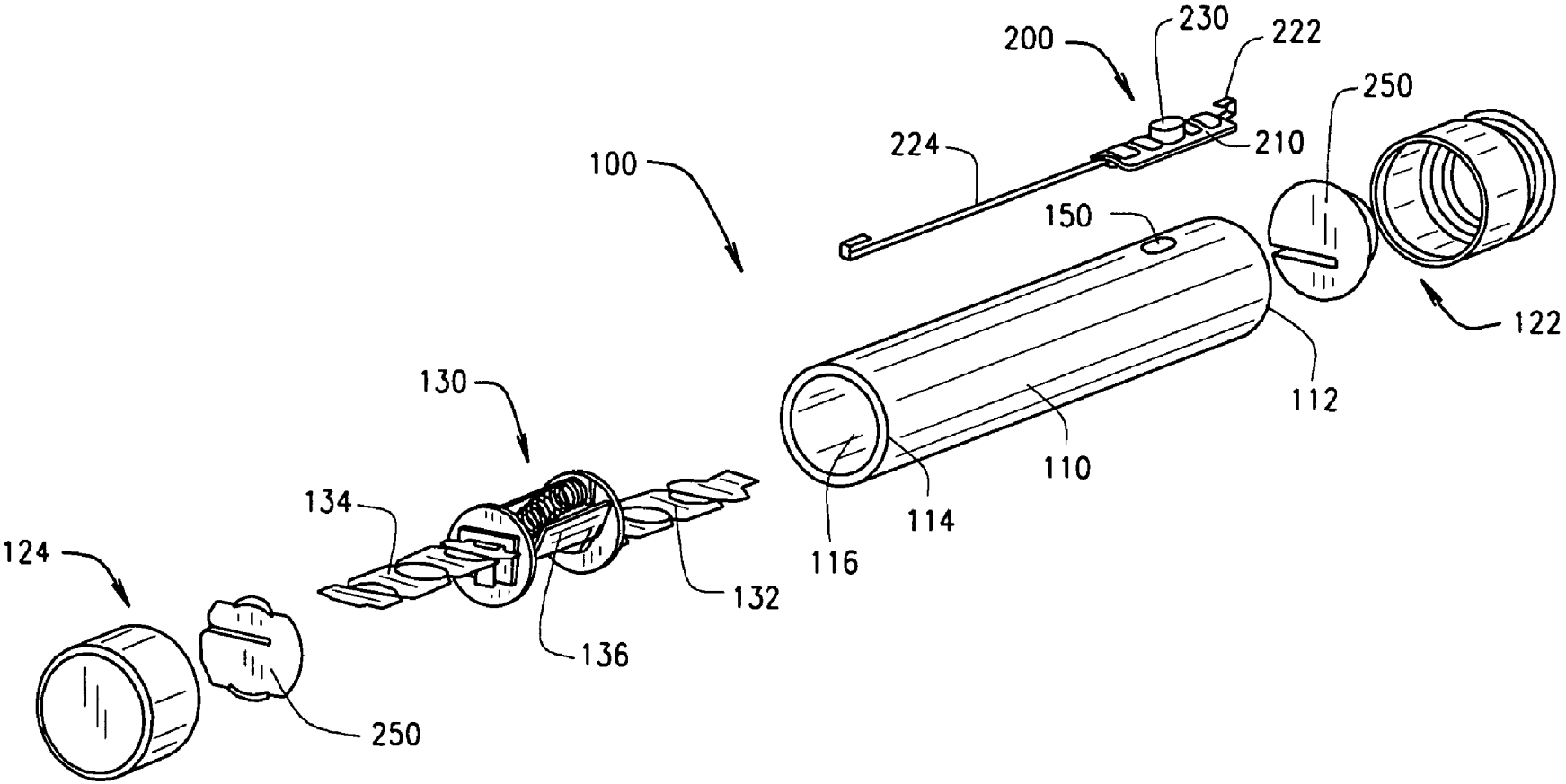
FIG. 5 is an exploded view of an embodiment of a fuse including a state indicator.

FIG. 5 is an exploded view of an exemplary embodiment of the fuse 100 including the fuse state indicator assembly 200. In this embodiment, the fuse 100 includes the cylindrical fuse body 110 having the first end 112, the second end 114 and the fuse bore 116 extending therebetween which receives the fuse state indicator 200 and the fuse element assembly 130. The fuse state indicator 200 is elongated in the longitudinal direction and curved in the lateral direction so that the fuse state indicator maintains contact with the inner surface of the fuse body 110. The fuse body 110 further includes the aperture 150 extending therethrough at a location proximate to the fuse body first end 112. The fuse state indicator is located proximate to the aperture 150 so that the transparent lens is visible through the aperture 150 and substantially flush with an outer surface of the fuse body 110. The end caps 122, 124 are attached to the fuse body 110 on either end thereof.

The fuse element assembly 130 is placed into the fuse bore 116 and is a known dual element time delay fuse element assembly having first and second short circuit strips 132 and 134 with a time delay element 136 in between. The first short circuit strip 132 and the second short circuit strip 134 include one or more weak spots or areas of reduced cross sectional area therein. The first and second short circuit strips 132, 134 are mechanically and electrically connected to the end caps 112, 114 in a known manner such as, for example, via conductive washers 250.

In an exemplary embodiment, the first and second short circuit strips 132, 134 are axially offset from one another on either side of the time delay element 136. The offset short circuit strip 132 is positioned in the fuse bore 116 relative to the fuse state indicator 200 and is spaced a distance from the fuse state indicator assembly 200. As such, heat and potential arc energy released when the short circuit strip 132 opens is less likely to damage the fuse state indicator assembly 200.

The fuse state indicator assembly 200 is adapted to be inserted into the fuse bore 116. The fuse state indicator assembly 200 extends on the interior of fuse body 110 and is positioned proximate to the aperture 150 within the fuse body 110. When the fuse state indicator assembly 200 is so positioned, the transparent lens 230 extends across the aperture 150 and is generally flush with the outer surface of the fuse body 110. The aperture 150 is positioned at a location proximate to the fuse body first end 112 so as to minimize the effects of electrical arcing caused by the fuse element assembly 130. The fuse state indicator assembly 200 is further held in place by the first clip 222 and the second clip 224 as indicated above. The first clip 222 and the second clip 224 are of differing lengths so that the fuse state indicator assembly 200 can be appropriately positioned with respect to the aperture 150.

Figure 6:
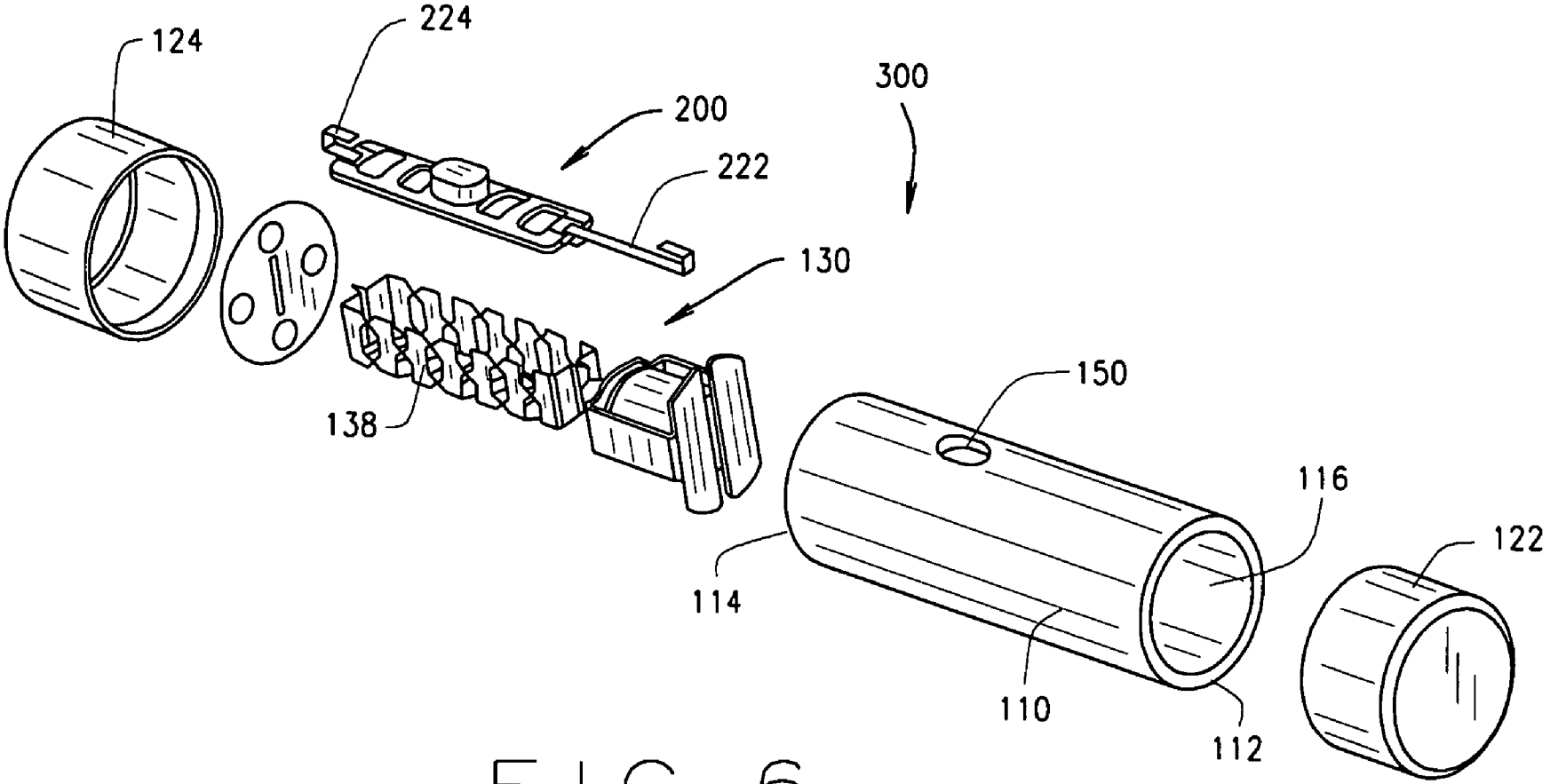
FIG. 6 is an exploded view similar to FIG. 5 but illustrating another embodiment of a fuse having a state indicator.

FIG. 6 shows an exploded view of an alternative embodiment of a fuse 300 in which common elements of fuses 300 and 100 are numbered with like reference characters. The fuse 300 includes a fuse body 110 having an aperture 150 and end caps 112, 114. The fuse 300 further includes a fuse state indicator assembly 200 as generally described above. In this embodiment the fuse element assembly 130 is a known "class J" fuse element. An open side of a short circuit strip 138 is positioned to face the fuse state indicator assembly 200 so that heat and potential arc energy released when the short circuit strip 138 opens is less likely to damage the fuse state indicator assembly 200.

Having now described different embodiments of cylindrical fuses having different types of fuse element assemblies, it should now be understood that the above described fuse state indicator may be adapted to accommodate a variety of different types of fuses. With appropriate modification of the conductive clips which connect the indicator to the fuse end caps, the indicator may be securely positioned at a desired location within the fuse body to appropriately space the indicator from primary fuse elements. Reliable fuse state indication is therefore provided for substantially universal use across a full product line of fuses.

Figure 7:
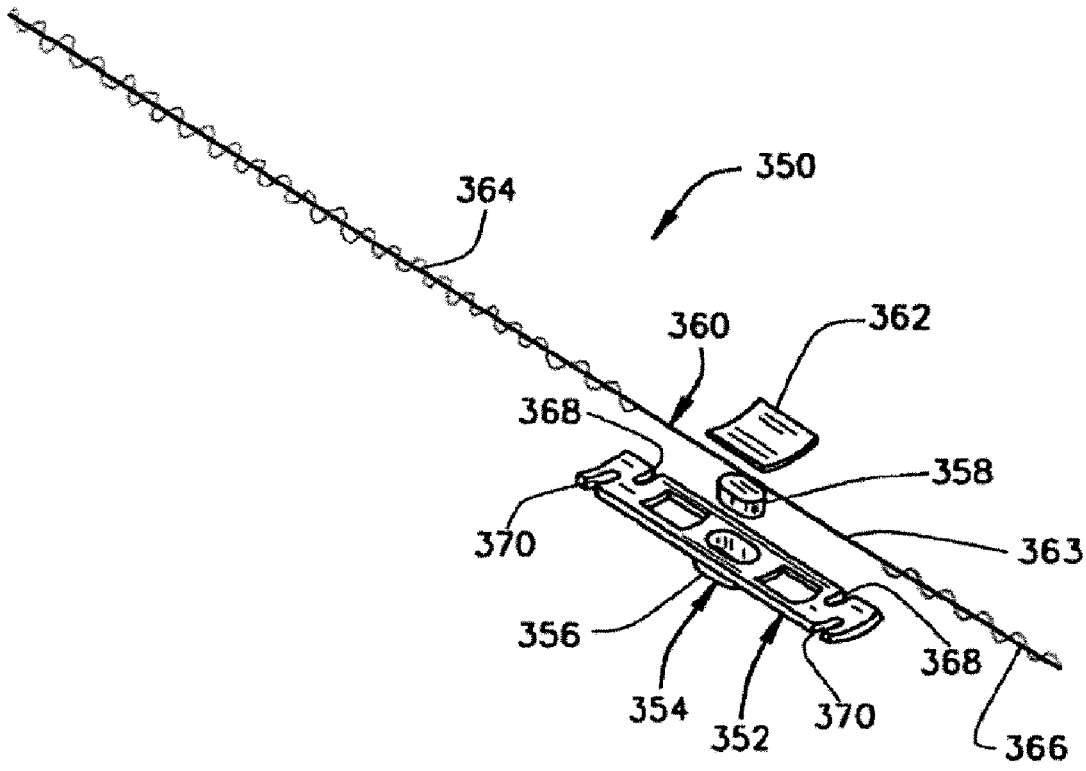
FIG. 7 is an exploded view of another exemplary embodiment of a fuse state indicator.

FIG. 7 is an exploded view of another exemplary embodiment of a fuse state indicator assembly 350 which may utilized with an insulative body, such as the body 110 (shown in FIGS. 1 and 2), to construct a fuse with a local fuse state indication feature which is visible through the an aperture in the body, such as the aperture 150 (shown in FIGS. 1 and 2) in the body 110.

Like the indicator assembly 200 described above, the fuse state indicator assembly 350 includes an insulative extension member 352 having a recessed cylindrical housing 354 extending therefrom, a transparent lens 356 coupled to the housing 354, a combustible substance 358 disposed within the housing 354, a secondary fuse link 360 extending across the extension member 352, and a flexible backing layer 362.

Unlike the indicator assembly 200 having a secondary fuse link 234 coupled to conductive clips 222, 224 (shown in FIGS. 3-6) for terminating the secondary fuse link to the end caps of the fuse, the assembly 350 employs a secondary fuse link or element 360 having a high resistance portion 363 and integrated lower resistance portions 364 and 366 on either side of the high resistance portion 363. The low resistance portions 364 and 366 of the fuse link 360 may be directly coupled to the fuse end caps without external connecting elements, such as the clips 222 and 224 described above. As such, the external clips 222 and 224 and associated fasteners may be eliminated and a simpler construction of the fuse is provided.

In an exemplary embodiment, the secondary fuse link 360 is fabricated from a fine fuse wire, such as, for example, a thin wire fabricated from copper, a copper alloy, or chrome, having a predetermined resistance which forms the high resistance portion 363. A second wire, which is different from fuse wire, is wrapped or twisted about the fine fuse wire on the ends thereof to form the lower resistance portions 364, 366 on either side of the high resistance portion 363. A central portion of the fuse wire (i.e., the high resistance portion 363) in the vicinity of the combustible substance 358, however, does not include the second wire twisted thereabout. In an illustrative embodiment, the second wire has a comparatively lower resistance than the fuse wire and is for example, wound about the fuse wire for about 60 twists to form the lower resistance portions 364 and 366 in the fuse link 360. The twisted wire on the fuse wire of the secondary fuse link 360 effectively creates lower resistance termination portions 364 and 366 which may be mechanically and electrically connected to the fuse end caps in a known manner (e.g., soldering), while providing a high resistance portion 363 proximate the combustible substance 358. The high resistance portion 363 ensures reliable ignition and consumption of the combustible substance 350 in an overcurrent condition to reveal the contrasting backing layer 362 and identify the operative state of the fuse as described above.

In an alternative embodiment, the fuse link 360 having a high resistance portion 363 and lower resistance portions 364 and 366 may be fabricated from a high resistance fine fuse wire coated, plated or overlaid with, for example, copper or another suitable material having a lower resistance. A portion of the copper plating may be stripped, cut, or otherwise removed from the plated wire to form the high resistance portion 363. The remaining plated portions of the wire flanking the high resistance portion 363 form the lower resistance portions 364 and 366 for termination to the end caps.

In an illustrative embodiment, slots 368, 370 are provided in the extension member 352 which receive the secondary fuse link 360 to assist in orienting or positioning the fuse link 360 in relation to the combustible substance 358. The flexible backing layer 362 is coupled to the extension member 352 as described above to maintain the fuse link 360 in a desired position relative to the combustible substance 358 and the transparent lens 356.

The assembly 350 is readily adaptable to a variety of bodies used in the fabrication of fuses, and in particular may be utilized in cylindrical fuses having various types of fuse element assemblies, including but not limited to the primary fuse elements and assembles described above. By adjusting the lengths of the low resistance portions 364, 366 of the secondary fuse link 360, the indicator may be securely positioned at a desired location within the fuse body to appropriately space the indicator from primary fuse elements, and establishing electrical connection to the end caps of the fuse may be greatly simplified. Reliable fuse state indication is therefore provided for substantially universal use across a full product line of fuses.

While the invention has been described in terms of various specific embodiments, those skilled in the art will recognize that the invention can be practiced with modification within the spirit and scope of the claims.

What is claimed is:

1. A fuse comprising:

an insulative body;

first and second conductive elements coupled to the body and respectively configured to connect to line side electrical circuitry and load side electrical circuitry; and a wire fuse element comprising a fuse wire extending between the first and second conductive elements, the fuse wire comprising a first end, a second end, and a middle portion extending between the first end and the second end, and a twisting wire, a first portion of which is wrapped about the first end of the fuse wire and a second portion of which is wrapped about the second end of the fuse wire, wherein each of a first portion of the wire fuse element comprising the first end of the fuse wire and the first portion of the twisting wire wrapped thereabout and a second portion of the wire fuse element comprising the second end of the fuse wire and the second portion of the twisting wire wrapped thereabout has an electrical resistance less than that of a third portion of the wire fuse element comprising the middle portion of the fuse wire.

2. The fuse of claim 1, wherein the fuse wire has a first electrical resistance at least approximately equal to the electrical resistance of the third portion of the wire fuse element, and the twisting wire has a resistance lower than the first resistance.

3. The fuse of claim 1, wherein the resistance of the first portion of the wire fuse element is at least approximately equal to the resistance of the second portion of the wire fuse element.

4. The fuse of claim 1, further comprising a primary fuse element extending between the first and second conductive elements, the primary fuse element being separately provided from the wire fuse element, and the wire fuse element being connected in parallel with the primary fuse element.

5. The fuse of claim 1, wherein at least one of the first and second conductive elements comprises an end cap.

6. The fuse of claim 1, wherein the insulative body is generally cylindrical.

7. The fuse of claim 1, further comprising a fuse state indication element coupled to the wire fuse element.

8. The fuse of claim 7, wherein the indication element is combustible.

9. The fuse of claim 8, wherein the middle portion of the fuse wire is configured to ensure reliable ignition and consumption of the combustible substance in an overcurrent condition.

10. A fuse comprising:

a body;

a line-side conductive element coupled to the body;

a load-side conductive element coupled to the body;

a primary fuse element extending between the line-side and load-side conductive elements; and a secondary fuse element electrically connected in parallel with the primary fuse element, wherein the secondary fuse element comprises a fuse wire extending between the line-side conductive element and the load-side conductive element, wherein the secondary fuse element comprises a first end having a first electrical resistance and a second end having a second electrical resistance, the first electrical resistance being at least approximately equal to the second electrical resistance, and wherein the secondary fuse element further comprises a middle portion extending between the first end and the second end and having a third electrical resistance higher than the first electrical resistance and the second electrical resistance;

wherein the first end of the secondary fuse element comprises a portion of a second wire wrapped about a first end of the fuse wire, and the second end of the secondary fuse element comprises another portion of the second wire wrapped about a second end of the fuse wire, the second wire having an electrical resistance lower than the third electrical resistance.

11. The fuse of claim 10, wherein the middle portion of the secondary fuse element is devoid of the second wire.

12. The fuse of claim 10, wherein at least one of the first and second conductive elements comprises an end cap.

13. The fuse of claim 10, wherein the insulative body is generally cylindrical.

14. The fuse of claim 10, further comprising a fuse state indication element responsive to current conditions of the secondary fuse element.

15. The fuse of claim 14, wherein the fuse state indication element is combustible.

16. The fuse of claim 15, wherein the third portion of the wire fuse element is configured to ensure reliable ignition and consumption of the combustible substance in an overcurrent condition.

17. A method of fabricating a fuse element having a high resistance portion and a low resistance portion, comprising the steps of:

providing a first wire having a first electrical resistance;

providing a second wire having an electrical resistance lower than the first electrical resistance; and winding the second wire about a first end and a second end of the first wire, to thereby create a high resistance portion and first and second low resistance portions, the high resistance portion comprising a portion of the first wire extending between the first end and the second end of the first wire, the first low resistance portion comprising the first end of the first wire and a portion of the second wire wrapped thereabout, and the second low resistance portion comprising the second end of the first wire and another portion of the second wire wrapped thereabout, wherein each of the first low resistance portion and the second low resistance portion has a lower electrical resistance than the high resistance portion.

* * * * *